US011739505B1

(12) United States Patent
Merritt

(10) Patent No.: US 11,739,505 B1
(45) Date of Patent: Aug. 29, 2023

(54) WATER WELL REHABILITATION SYSTEM

(71) Applicant: Justin Merritt, Jacksonville, FL (US)

(72) Inventor: Justin Merritt, Jacksonville, FL (US)

( * ) Notice: Subject to any disclaimer, the term of this patent is extended or adjusted under 35 U.S.C. 154(b) by 10 days.

(21) Appl. No.: 17/399,916

(22) Filed: Aug. 11, 2021

Related U.S. Application Data

(60) Provisional application No. 63/064,238, filed on Aug. 11, 2020.

(51) Int. Cl.

| | |
|---|---|
| ***E03B 3/15*** | (2006.01) |
| ***E21B 37/06*** | (2006.01) |
| ***E21B 47/00*** | (2012.01) |
| ***E21B 34/16*** | (2006.01) |
| ***E21B 21/00*** | (2006.01) |
| ***E21B 47/06*** | (2012.01) |

(52) U.S. Cl.
CPC ..... *E03B 3/15* (2013.01); *E21B 21/00* (2013.01); *E21B 34/16* (2013.01); *E21B 37/06* (2013.01); *E21B 47/00* (2013.01); *E21B 47/06* (2013.01)

(58) Field of Classification Search
CPC ..... E03B 3/08; E03B 3/12; E03B 3/15; E21B 21/00; E21B 37/06; E21B 47/00; E21B 47/06
See application file for complete search history.

(56) References Cited

U.S. PATENT DOCUMENTS

| | | | |
|---|---|---|---|
| 2,045,899 | A | 6/1936 | Davis |
| 2,161,085 | A | 6/1939 | Clifton |
| 2,322,484 | A | 6/1943 | Stuart |
| 2,802,537 | A | 8/1957 | Goldinger |
| 2,824,833 | A | 2/1958 | Cardwell |
| 3,122,204 | A | 2/1964 | Oakes |
| 3,142,335 | A | 7/1964 | Dill |
| 3,251,415 | A | 5/1966 | Bombardieri |
| 3,828,854 | A | 8/1974 | Richardson |
| 3,899,027 | A | 8/1975 | Jenkins |
| 4,254,831 | A | 3/1981 | Nuzman |
| 4,392,529 | A | 7/1983 | Burwell |
| 4,534,413 | A | 8/1985 | Jaworowsky |
| 5,392,814 | A | 2/1995 | Brotcke |
| 5,400,430 | A | 3/1995 | Nenniger |
| 5,979,556 | A | 11/1999 | Gallup et al. |

(Continued)

FOREIGN PATENT DOCUMENTS

| | | |
|---|---|---|
| WO | 2003036013 | 5/2003 |
| WO | 2019164956 | 8/2019 |

*Primary Examiner* — Robert E Fuller
(74) *Attorney, Agent, or Firm* — John Rizvi; John Rizvi, P.A.—The Patent Professor®

(57) ABSTRACT

A water well rehabilitation system is provided for a water well having an open borehole through an aquifer substrate which extends to the bottom of the water well. The system includes an acid injection assembly having a concentrated acid supply, a water supply, and an eductor to mix the concentrated acid with water to form an acid solution to inject into one or more predetermined elevations in the open borehole. An acid injection control assembly includes a concentrated acid control valve and a water supply control valve cooperatively operative to maintain a predetermined acid concentration in the acid solution formed in and discharged from the eductor. A flush water assembly is disposed to inject an amount of flush water into the water well, and a well monitoring assembly monitors at least one operating parameter while a rehabilitation process is being performed in the water well.

20 Claims, 5 Drawing Sheets

(56) References Cited

U.S. PATENT DOCUMENTS

| | | | |
|---|---|---|---|
| 6,250,388 | B1 | 6/2001 | Carmi et al. |
| 7,059,414 | B2 | 6/2006 | Rae |
| 8,205,676 | B2 | 6/2012 | Nelson et al. |
| 8,312,930 | B1 | 11/2012 | Glass |
| 9,366,113 | B2 | 6/2016 | Etschel |
| 10,465,480 | B2 | 11/2019 | Dennis |
| 10,465,493 | B2 | 11/2019 | Mills |
| 10,577,535 | B2 | 3/2020 | Reddy |
| 2008/0185150 | A1 | 8/2008 | Brown |
| 2009/0209439 | A1 | 8/2009 | Qiu |
| 2017/0198195 | A1 | 7/2017 | Beuterbaugh et al. |

WATER WELL REHABILITATION SYSTEM

CROSS-REFERENCE TO RELATED APPLICATIONS

This application claims the benefit of U.S. Provisional Patent Application Ser. No. 63/064,238 filed on Aug. 11, 2020, which is incorporated by reference herein in its entirety.

FIELD OF THE INVENTION

The present invention relates generally to water well rehabilitation system.

BACKGROUND OF THE INVENTION

Water wells which are installed in aquifers surrounded by a carbonate mineral substrate, such as, limestone and/or dolomite, are the predominant source of fresh water in many parts of the world, whether for individual use or for entire communities and municipalities. A typical water well includes a well casing, such as a steel pipe, which is installed from the ground and extends downward to the top of the aquifer, with an open borehole drilled below into the water bearing carbonate mineral substrate. A well casing may extend hundreds of feet into the ground in order to reach the top of a desired aquifer, and an open borehole may be drilled hundreds if not thousands of feet below the bottom of a well casing in a typical water well. A well head is often installed around the casing at the ground surface to support the well casing, pups, piping, etc., and so as to prevent the infiltration of contaminants into the water well and the underlying aquifer.

Over time, it is common for the yield or amount of fresh water which may be obtained from a water well installed in a carbonate mineral substrate to diminish over time. This is due in part to the fact that carbonate minerals tend to precipitate within the pore spaces in the carbonate mineral substrate in the immediate vicinity of an open borehole of a water well.

It is well know that carbonate minerals are very reactive with strong acids. The reaction of a strong acid with precipitated carbonate minerals results in dissolving the carbonate mineral precipitate, thereby unclogging the pore spaces in the carbonate mineral substrate in the immediate vicinity of an open borehole of a water well, thereby at least partially, if not fully, restoring the water well to yield its full capacity of fresh water.

A byproduct of the chemical reaction which occurs when carbonate minerals are dissolved by a strong acid is carbon dioxide, often, in large amounts. Ad hoc procedures for rehabilitation of such water wells have been performed for many years. Such procedures involving adding hydrochloric acid directly into an open borehole of a water well. In addition, these procedures typically involve high rates of addition of concentrated hydrochloric acid directly into the open borehole of the water well.

The primary risk associated with introducing acid into a water well installed in a carbonate mineral substrate aquifer is what is well known in the industry as a "well kick." More in particular, a well kick is initiated by large amounts of carbon dioxide being generated from the reaction of an acid with carbonate minerals present in an open borehole in a water well. Carbon dioxide is more soluble in water at higher fluid pressures, such as those that are present in an open borehole of a water well, and the pressure increases with depth in the open borehole of a water well.

Carbon dioxide remains in solution in water below a certain depth in a water well, however, it is be released from solution and form gas bubbles above that depth. More in particular, when carbon dioxide moves into the upper portions of the water column in the water well, it is released from solution. Once a gas bubble is formed it is subject to buoyancy and tends to continue to move upward to shallower depths in the water column in the water well, often resulting in large volumes of gas moving upward into the well casing.

Further, carbon dioxide gas bubbles experience a large increase in volume as they move upward in the water column in a water well, and often, high gas pressures are formed in well casings as a result of carbon dioxide being released from solution and rising upward into and through the well casing, which can damage, if not destroy, the components of the water well, if not the water well itself. A sufficient volume of rapidly expanding carbon dioxide gas moving upward through a well casing acts as a pump, pulling water and any dissolved constituents from an open borehole upward into the casing and ejecting them out, often violently, from the top of the water well, producing the phenomenon known as a "well kick." In some cases, the integrity of a water well can fail under the pressures created by rapidly rising carbon dioxide gas, leading to a sudden and dramatic release of the carbon dioxide gas, often followed by a geyser of water, acid, rock, gas, pipe, etc., through the well head of the water well and onto the surrounding ground surface.

Although hydrochloric acid is very effective in restoring the capacity of water wells completed in carbonate aquifers, safety concerns have limited its use by municipal water utilities. Because of the potentially catastrophic nature of a well kick, many municipal water utilities are reluctant to assume such risks when considering acid rehabilitation of water wells located in urban or suburban environments. As a further result, water wells that may still have many years, perhaps decades, of useful productive lives may be abandoned in place, and the municipality, and ultimately the end users, must bear the expense of installing new water wells to meet the demands of the community.

Accordingly, there is an established need for a solution to the aforementioned problems which exist utilizing presently known techniques for the rehabilitation of water wells installed in carbonate substrate aquifers.

SUMMARY OF THE INVENTION

The present invention is directed to a water well rehabilitation system.

In a first implementation of the invention, a water well rehabilitation system is provided for a water well having a well casing installed in a borehole through an upper substrate, a well head mounted to an upper end of the well casing, and an open borehole through an aquifer substrate having a static water level therein, the open borehole extends downward from a bottom of the well casing to the bottom of the water well itself, the system comprising: an acid injection assembly including a concentrated acid supply, a water supply, and an eductor disposed to mix an amount of concentrated acid with an amount of water to form an acid solution therein and to inject the acid solution into the water well at at least one predetermined elevation in the open borehole thereof; an acid injection control assembly having a concentrated acid control valve and a water supply control valve cooperatively operative to maintain a predetermined acid concentration in the acid solution formed in and discharged from the eductor; a flush water assembly disposed to inject an amount of flush water into the water well; and, a well monitoring assembly monitors at least one operating parameter while a rehabilitation process is being performed in the water well.

In a second aspect, the water well rehabilitation system can include an acid injection system having a concentration sensor positioned to measure a concentration of acid in an acid solution formed in and discharged from an eductor, wherein the concentration sensor generates a concentration sensor signal communicative with an acid injection control assembly to facilitate maintaining a predetermined acid concentration in the acid solution formed in and discharged from the eductor.

In yet one other aspect, the water well rehabilitation system may have an acid injection system including a concentration sensor positioned to measure a concentration of acid in an acid solution formed in and discharged from an eductor, wherein the concentration sensor generates a concentration sensor signal and transmits the concentration sensor signal to a system controller operative with an acid injection control system to cause a concentrated acid control valve and/or a water supply control valve to allow greater or lesser flow therethrough to maintain a predetermined acid concentration in the acid solution formed in and discharged from the eductor.

In another aspect, the water well rehabilitation system may have an acid injection assembly comprising an upper acid injection line disposed in the open borehole of the water well proximate but below the bottom of the well casing of the water well.

In a further aspect, the water well rehabilitation system can include an acid injection assembly comprising a lower acid injection line disposed in the open borehole of the water well proximate but above the bottom of the water well.

In yet another aspect, the water well rehabilitation system may have an acid injection control assembly including a water supply alarm which generates and transmits a water supply alarm signal upon detection of a low water supply condition, wherein the acid injection control assembly causes at least a concentrated acid control valve to close upon receipt of a water supply alarm signal.

In one further aspect, the water well rehabilitation system can include an acid injection control assembly comprising a water supply alarm which generates and transmits a water supply alarm signal to a system controller upon detection of a low water supply condition, the system controller operative with the acid injection control system to cause the acid injection control assembly to close at least a concentrated acid control valve upon receipt of the water supply alarm signal.

In one other aspect, the water well rehabilitation system can include a flush water assembly having a flush water pump to inject an amount of flush water into the water well, wherein the flush water assembly further comprises a flush water injection line disposed to inject the amount of flush water into the water well proximate but below the elevation of the static water level in the water well.

In still another aspect, the water well rehabilitation system may have a well monitoring assembly comprising a pressure sensor disposed to measure a pressure proximate the well head of a water well at least while a water well rehabilitation process is being performed in the water well, wherein the pressure sensor is further disposed to transmit a pressure signal at least while the water well rehabilitation process is being performed in the water well.

In one further aspect, the water well rehabilitation system can include a well monitoring assembly having a conductivity sensor disposed to measure a conductivity in a water column in the open borehole of the water well proximate but below the bottom of the well casing at least while a water well rehabilitation process is being performed in the water well, wherein the conductivity sensor is further disposed to transmit a conductivity signal at least while the water well rehabilitation process is being performed in the water well.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
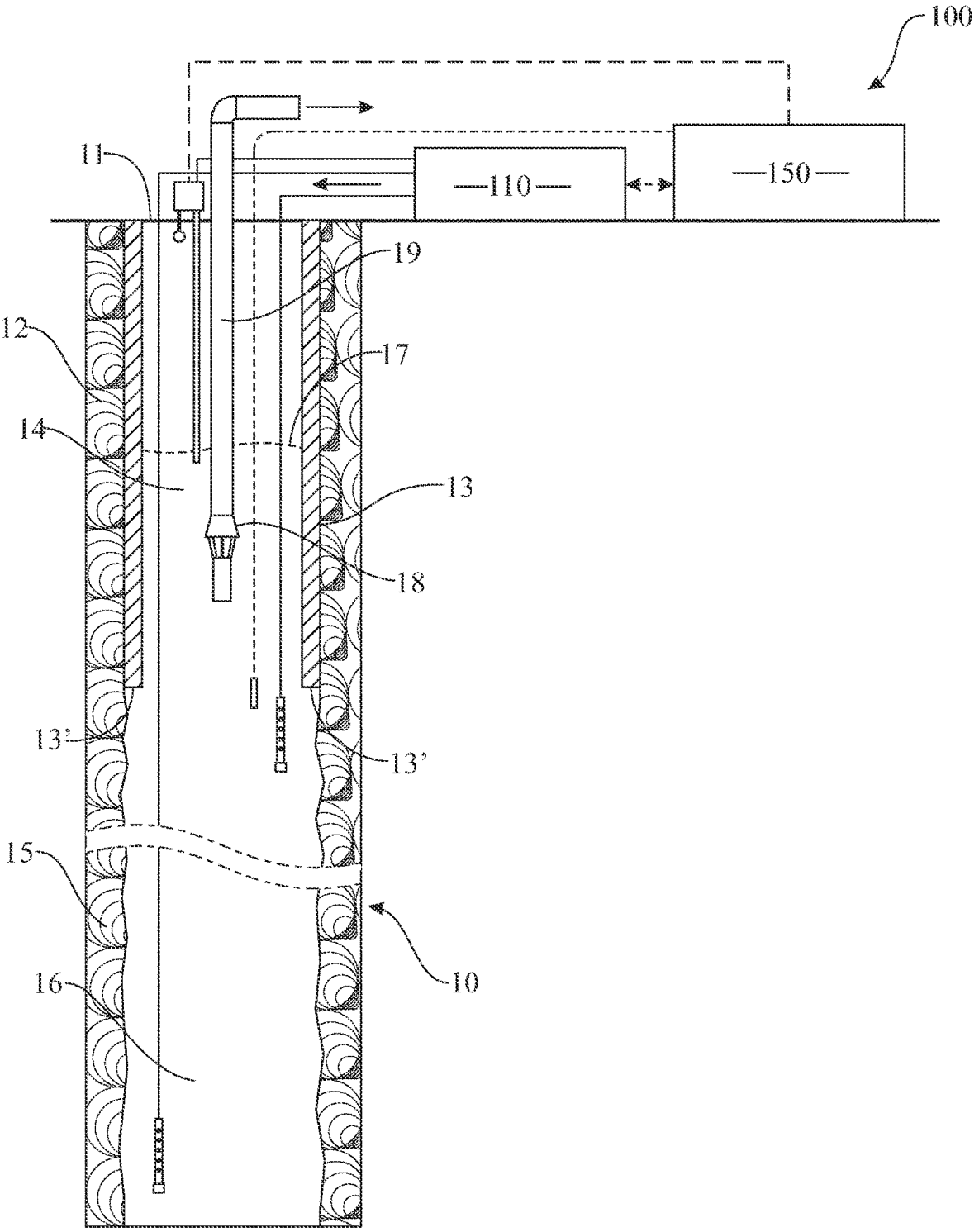
FIG. 1 presents a diagrammatic representation of one illustrative embodiment of a water well rehabilitation system installed in a water well, in accordance with the present invention.
Figure 2:
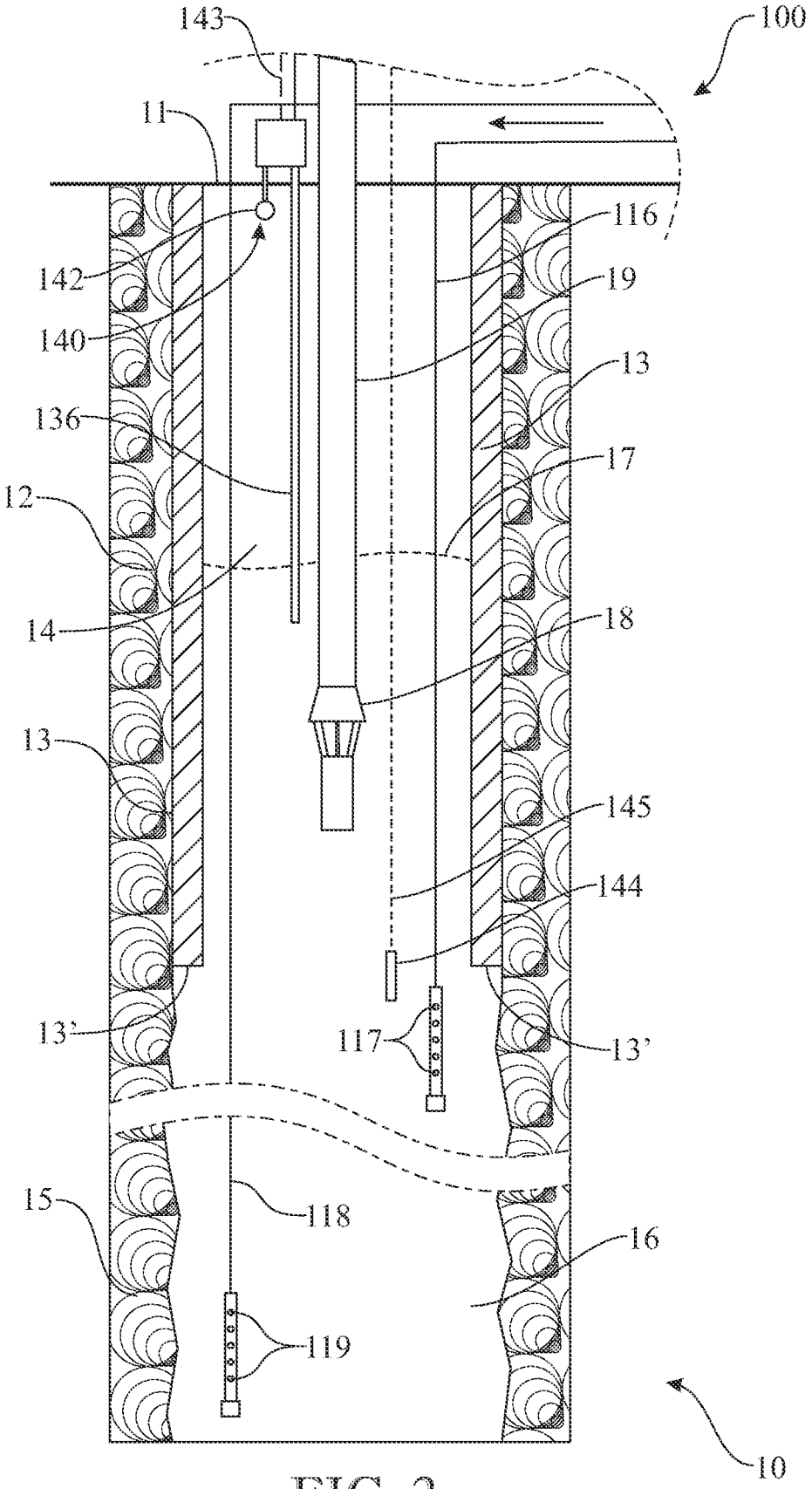
FIG. 2 presents a partial diagrammatic representation of the water well rehabilitation system of FIG. 1 installed in the water well, in accordance with the present invention.

Shown throughout the figures, the present invention is directed toward a water well rehabilitation system. Referring initially to FIGS. 1 and 2, diagrammatic representations of one illustrative embodiment of a water well rehabilitation system 100, in accordance with the present invention, installed in a water well 10 are presented.

With reference initially to FIG. 1, a typical water well 10 is presented in some detail so as to provide context for the present invention. As may be seen from FIG. 1, the water well 10 includes a well casing 13 which is positioned into a casing borehole formed through an upper substrate 12, such as by drilling. Is to be appreciated that a water well 10 may be located and dimensioned to provide water service to an individual property or group of properties located in the vicinity of the water well 10, in which case, the well casing may only be several inches in diameter. Furthermore, a water well 10 may be fairly shallow in some instances such that a well casing 13 need only extend perhaps 10 to 20 feet below grade in order to access a shallow aquifer. In other cases, depending on the hydrology in the area in which a water well 10 is to be installed, a well casing 13 may extend hundreds of feet below grade in order to reach an aquifer suitable to provide a source of fresh water. It is further to be appreciated that a water well 10 may be located and dimensioned to provide water service to entire community, in which case, the dimensions of the water well 10, and the corresponding well casing 13, are necessarily greatly increased, such as being several feet in diameter and extending hundreds of feet below grade to reach a desired aquifer. A well casing 13 may be constructed from any of a variety of materials including plastic, steel, etc. In either instance, a well head 11, as shown best in the illustrative embodiment of FIG. 3 and as discussed in more detail below, is typically mounted to an upper end of the well casing 13. A well head 11 is often constructed of concrete which is formed around an upper portion of a well casing 13.

As further shown in FIG. 1, the water well 10 further comprises an open borehole 16 which is formed, once again, such as by drilling, through an aquifer substrate 15. As noted above, the majority of the water wells 10 installed around the world are found in an aquifer substrate 15 formed of a carbonate rock, such as limestone and/or dolomite. Based on a number of factors related to a required yield of a water well 10, an open borehole 16 may extend hundreds or even thousands of feet below grade through an aquifer substrate 15 extending from the bottom of the well casing 13, and co-linear therewith, to the bottom of the water well 10. Further, and again based upon the yield required from a water well 10, an open borehole 16 may easily be as long as the well casing 13 itself, and in some instances, an open borehole 16 may be two or three times as long as a corresponding well casing 13, such as is shown, by way of example, diagrammatically in FIG. 1.

In many cases, and in particular where a water well 10 is installed for high-capacity production, the water well further includes a pump 18 which is typically mounted on and supported by a water discharge pipe 19 which extends downwardly through the well head 11 mounted to the top of the well casing 13 to the pump 18, such as is shown by way of example in the illustrative embodiments of FIGS. 1 and 2. As further shown in FIGS. 1 and 2, a pump 18 is installed in a water well 10 at an elevation below an elevation of a static water level 17 in the aquifer in which the water well 10 is installed. More in particular, a pump 18 is installed a sufficient distance below an elevation of a static water level 17 to allow for drawdown of the water table by the pump 18, as well as to account for any seasonal variations in the static water level 17. As will be appreciated, in some instances a well casing 13 is installed so as to extend below a static water level 17 in a particular aquifer, such that the static water level 17 extends upwardly into at least a portion of the well casing 13, once again, as may be seen in the illustrative embodiments of FIGS. 1 and 2. As will be further appreciated, in other instances, a well casing 13 may be installed such that the bottom of the well casing 13 is at an elevation which is essentially coincident with a static water level 17 in a particular aquifer, in which case, a pump 18 may be installed into a portion of an open borehole 16 itself.

As noted above, when a water well 10 is installed into an aquifer formed in an aquifer substrate 15 comprising carbonate rock, such as limestone and/or dolomite, it is a common and unfortunately serious problem for the yield of such a water well 10 to decrease over time, in some cases substantially, as a result of the precipitation of carbonaceous materials which deposit and block the porous sidewalls of the open borehole 16, thereby significantly decreasing the yield of fresh water from the water well 10. It is the resolution of this very problem in a safe and efficient manner which the present water well rehabilitation system 100 achieves.

With reference once again to the diagrammatic representation as shown in FIG. 1, a water well rehabilitation system 100 in accordance with at least one embodiment of the present invention comprises an acid injection assembly 110. In one further embodiment, a water well rehabilitation system 100 further comprises a system control assembly 150 which, as shown in the illustrative embodiment of FIG. 1, is disposed in a communicative relationship with the acid injection assembly 110.

Figure 4:
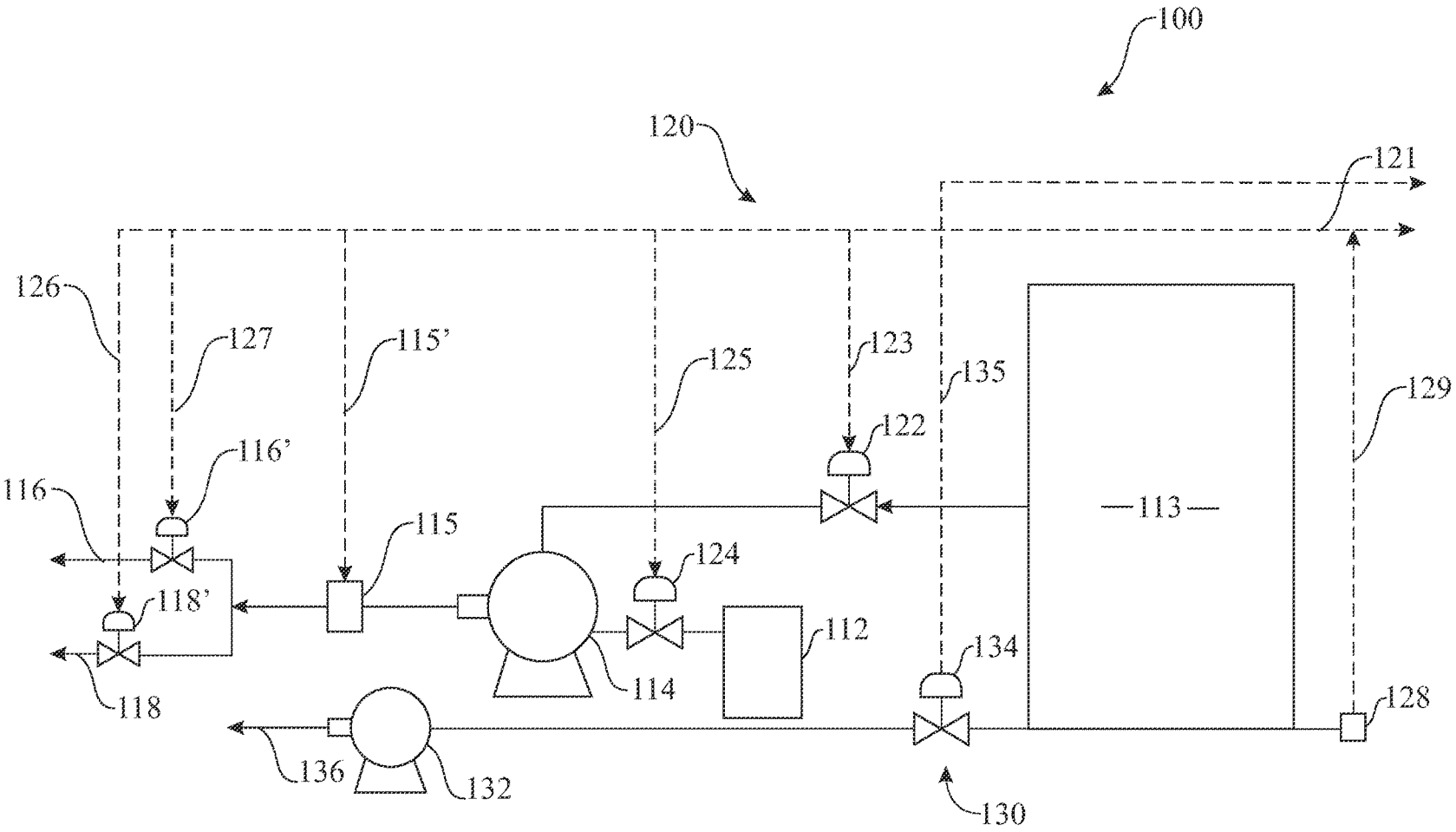
FIG. 4 presents a partial diagrammatic representation of one illustrative embodiment of an acid injection assembly, an acid injection control assembly, and a flush water assembly, in accordance with the present invention.

Looking next to FIG. 4, a partial diagrammatic representation of an acid injection assembly 110, an acid injection control assembly 120, and a flush water assembly 130 of a water well rehabilitation system 100 in accordance with at least one embodiment of the present invention is shown.

As an initial matter, an acid injection assembly 110 comprises a concentrated acid supply 112. In accordance with at least one embodiment of the present water well rehabilitation system 100, a concentrated acid supply 112 comprises an amount of hydrochloric acid having a concentration of about ten (10) percent to about thirty-two (32) percent, by weight. In at least one further embodiment, a concentrated acid supply 112 comprises an amount of hydrochloric acid having a concentration of about ten (10) percent to about twenty (20) percent, by weight. Is still one further embodiment, a concentrated acid supply comprises an amount of hydrochloric acid having a concentration of about twenty (20) percent, by weight. It is to be appreciated that a water well rehabilitation system 100 in accordance with the present invention may utilize any of a number of concentrated acids including, but not limited to, phosphoric acid, sulfamic acid, oxalic acid, etc., just to name a few.

With continued reference to FIG. 4, an acid injection assembly 110 in accordance with at least one embodiment of the present invention further comprises a water supply 113. As depicted diagrammatically in FIG. 4, in one embodiment, a water supply 113 may comprise a water supply tank, however, in at least one other embodiment, a water supply 113 may comprise a pressurized source of water, such as a pressurized water supply line. In at least one embodiment, a water supply 113 comprises potable water.

As further shown in the illustrative embodiment of FIG. 4, an acid injection assembly 100 in at least one embodiment comprises an eductor 114. An eductor 114 is structured to mix an amount of concentrated acid from a concentrated acid supply 112 with an amount of water from a water supply 113 to form an acid solution therein. In at least one further embodiment, an eductor 114 is further structured to discharge the acid solution formed therein into a portion of an open borehole 16 of a water well 10. In at least one embodiment, an eductor 114 comprises a booster pump to facilitate discharge of the acid solution formed therein into portions of an open borehole 16.

More in particular, in accordance with at least one embodiment of the present invention, an eductor 114 is structured to mix an amount of concentrated acid with an amount of water to form an acid solution therein having a predetermined acid concentration. In accordance with at least one embodiment of the present water well rehabilitation system 100, a predetermined acid concentration of hydrochloric acid is about one (1.0) percent to about ten (10.0) percent, by weight. In at least one further embodiment, a predetermined acid concentration of hydrochloric acid is about four (4.0) percent to about eight (8.0) percent, by weight. Is still one further embodiment, a predetermined acid concentration of hydrochloric acid is about six (6.0) percent, by weight. As before, it is to be appreciated that the present water well rehabilitation system 100 may utilize any of a number of acid solutions and/or predetermined acid concentrations as may be warranted by the hydrology and/or the degree of degradation of a particular water well 10.

In at least one embodiment, an acid injection assembly 110 in accordance with at least one embodiment of the present invention further comprises an acid concentration sensor 115. As may be seen from illustrative embodiment of FIG. 4, an acid concentration sensor 115 is disposed proximate a discharge from an eductor 114 so as to monitor the acid concentration in a the acid solution formed therein. A concentration sensor signal 115' is transmitted to an acid injection interface 152 of a system control assembly 150, discussed in greater detail hereinafter, via an acid injection control assembly signal 121, to facilitate monitoring and control of the predetermined acid concentration of the acid solution formed in and discharged from the eductor 114.

In at least one embodiment of a water well rehabilitation system 100 in accordance with the present invention, an acid injection control assembly 120 comprises a water supply control valve 122 and/or a concentrated acid control valve 124. As shown in the illustrative embodiment of FIG. 4, an acid injection assembly 110 comprises a water supply 113 having a water supply control valve 122 disposed in fluid communication with an eductor 114. A water supply control valve signal 123 is received from an acid injection interface 152 of a system control assembly 150, once again, as discussed in greater detail hereinafter, wherein the water supply control valve signal 123 controls operation of the water supply control valve 122 to discharge a precise amount of water as needed to maintain a predetermined acid concentration in the acid solution formed in the eductor 114, as well as to terminate the flow of water altogether as needed.

As further shown in the illustrative embodiment of FIG. 4, a concentrated acid supply 112 includes a concentrated acid control valve 124 which is also disposed in fluid communication with the eductor 114. Similar to the water supply control valve 122, a concentrated acid control valve signal 125 is received from the acid injection interface 152 of the system control assembly 150, wherein the concentrated acid control valve signal 125 controls operation of the concentrated acid control valve 124 to discharge a precise amount of concentrated acid, once again, as needed to maintain a predetermined acid concentration in the acid solution formed in the eductor 114, as well as to terminate the flow of concentrated acid altogether, once again, as may be needed during a water well rehabilitation process.

As will be appreciated, the combination of a water supply control valve 122, a concentrated acid control valve 124, and a concentration sensor 115 all disposed in a communicative relation with an acid injection interface 152 of a system control assembly 150 via an acid injection control assembly signal 121 allows an acid injection assembly 110 of the present water well rehabilitation system 100 to generate an acid solution via an eductor 114 wherein the concentration of acid in the acid solution can be maintained at a desired and predetermined acid concentration, such as described hereinabove. In at least one embodiment, an acid injection assembly 110 is configured such that a predetermined acid concentration can be maintained within plus or minus about 1.0 percent by weight to about 0.50 percent by weight. In at least one further embodiment, an acid injection assembly 110 is configured such that a predetermined acid concentration can be maintained within plus or minus about 0.10 percent by weight, which provides sufficient control of the present water well rehabilitation system 100 so as to minimize if not prevent altogether occurrences of a well kick in the water well 10 during a water well rehabilitation process.

In at least one embodiment, an acid injection control assembly 120 further comprises a water supply alarm 128 disposed in communication with an acid injection interface 152 via water supply alarm signal 129. More in particular, a water supply alarm 128 detects a low water supply condition in a water supply 113, whether it be a specified low water level in a water supply tank or a specified low water pressure in a pressurized water supply line. Upon detection of a low water supply condition in a water supply 113, the water supply alarm 128 sends a water supply alarm signal 129 to the acid injection interface 152 of the system control assembly 150. In at least one embodiment, upon detection of a low water supply condition in a water supply 113, the water supply alarm 128 generates an audible and/or visual alarm to alert system operators of the low water supply condition. Upon receipt of the water supply alarm signal 129, the acid injection interface 152 of the system control assembly 150 is operative to cause the concentrated acid control valve 124 and/or the water supply control valve 122 to close, thereby terminating the injection of any acid solution into the open borehole 16 of the water well 10 until such time as a sufficient water supply 113 is once again available. As will be appreciated, the water supply alarm 128 provides a further failsafe to the present water well rehabilitation system 100 to assure that concentrated acid is not injected directly into the open borehole 16 of the water well 10, which could result in a damaging if not catastrophic well kick therein.

Looking further to FIG. 4, in at least one embodiment, an acid injection assembly 110 further comprises an upper acid injection line 116 and a lower acid injection line 118. As shown in the illustrative embodiment of FIG. 2, an upper acid injection line 116 is installed through a well head 11 of a water well 10 and the upper acid injection line 116 extends downward through the well casing 13 to a position proximate but below the bottom of the well casing 13'. As further shown in the illustrative embodiment of FIG. 2, a plurality of upper injection apertures 117 are formed through the lower end of the upper acid injection line 116 so as to permit an acid solution formed in an eductor 114 to be discharged through the plurality of upper injection apertures 117 into a portion of the open borehole 16 of the water well 10 just below the bottom of the well casing 13'. As will be appreciated, as the acid solution having a predetermined concentration is injected into the open borehole 16 proximate but below the bottom of the well casing 13', the acid solution will react with the carbonaceous material buildup along the walls of the open borehole 16 thereby dissolving at least a portion of the carbonations buildup so as to permit water from the surrounding aquifer to flow more freely therethrough and into the open borehole 16 of the water well 10.

As also shown in the illustrative embodiment of FIG. 2, a lower acid injection line 118 is installed through a well head 11 of a water well 10 and the lower acid injection line 118 extends downward through the well casing 13 to a position proximate but above the bottom of the water well 10. As further shown in the illustrative embodiment of FIG. 2, a plurality of lower injection apertures 119 are formed through the lower end of the lower acid injection line 118 so as to permit an acid solution to be discharged through the plurality of lower injection apertures 119 into a portion of the open borehole 16 of the water well 10 just above the bottom of the water well 10. As will be appreciated, once again, as the acid solution having a predetermined concentration is injected into the open borehole 16 proximate but above the bottom of the water well 10, the acid solution will react with the carbonaceous material buildup along the walls of the open borehole 16, once again dissolving at least a portion of the carbonations buildup so as to permit water from the surrounding aquifer to flow more freely therethrough and into the open borehole 16 of the water well 10.

Although the upper acid injection line 116 and the lower acid injection line 118 as shown in the illustrative embodiment of FIG. 2 are disposed proximate the bottom of the well casing 13' and the bottom of the water well 10, respectively, it is to be appreciated that the upper acid injection line 116 and the lower acid injection line 118 may be positioned in any of a plurality of elevations along the length of the open borehole 16 of the water well 10 as may be warranted based upon visual inspection with a remote camera, well construction logs, hydrologic profiles, etc. It is also to be appreciated that a greater or lesser number of acid injection lines may be utilized in accordance with the present water well rehabilitation system 100 to inject an amount of an acid solution having a predetermined acid concentration at various elevations along the length of an open borehole 16 in a water well 10.

With reference once again to FIG. 4, in at least one embodiment an acid injection assembly 110 further comprises an upper acid injection line control valve 116' mounted in fluid communication with an upper acid injection line 116 which is operative to permit precise control of the flowrate of an acid solution having a predetermined acid concentration formed in an eductor 114 therethrough. Similarly, in at least one further embodiment, an acid injection assembly 110 further comprises a lower acid injection line control valve 118' mounted in fluid communication with a lower acid injection line 118 which is operative to permit precise control of the flowrate of an acid solution having a predetermined acid concentration formed in an eductor 114 therethrough. As further shown in the illustrative embodiment of FIG. 4, the acid injection control assembly 120 comprises an upper acid injection line control valve signal 126 and a lower acid injection line control valve signal 127 which are communicative with an acid injection interface 152 of the system control assembly 150 via acid injection control assembly signal 121. As such, the present water well rehabilitation system 100 is operable to control the injection of a precise amount of an acid solution having a predetermined acid concentration into predetermined elevations along the length of an open borehole 16 of a water well 10. It is to be appreciated that, as a result, the present water well rehabilitation system 100 permits the safe and efficient injection of a precise amount of an acid solution having a predetermined acid concentration into an open borehole 16 of a water well 10 precisely where needed and in amounts and concentrations sufficient to dissolve carbonate buildup on the walls of the open borehole 16 to permit flow of water from the surrounding aquifer therethrough, without generating carbon dioxide in amounts which could result in a potentially damaging or even catastrophic well kick in the water well 10.

FIG. 4 is further illustrative in at least one embodiment of a flush water assembly 130 in accordance with the present invention. As may be seen from FIG. 4, a flush water assembly 130 comprises a flush water pump 132 which discharges an amount of flush water into the water well 10 via a flush water injection line 136. In at least one embodiment, the flush water injected into the water well 10 comprises potable water. With reference once again to FIG. 2, in at least one embodiment, a flush water injection line 136 is installed through a well head 11 and extends downwardly through the well casing 13 to an elevation proximate but below the elevation of the static water level 17 in the water well 10, such that an amount of flush water may be injected directly into the water column in the water well 10. In at least one other embodiment, a flush water injection line 136 extends just a short distance below a well head 11 such that an amount of flush water is injected into the vapor headspace above the water column in the water well 10. In either instance, an amount of flush water injected into the water well serves to at least temporarily increase the head pressure in the water column in the water well 10, substantially if needed, so as to prevent the formation of gaseous reaction components. i.e., carbon dioxide gas, in the water column which may subsequently rise up and out of the water well 10, thereby resulting in a well kick. The flush water assembly 130 is further utilized to provide a continuous countercurrent flow of flush water into the water column in the water well 10 so as to push reaction components, once again, carbon dioxide, lower into the water column so as to maintain the carbon dioxide dissolved in solution to prevent a well kick.

Looking once again to FIG. 4, in at least one embodiment a flush water assembly 130 further comprises a flush water control valve 134 disposed between a flush water pump 132 and a water supply 113. A flush water control valve signal 135 is communicative with a flush water injection interface 154 of the system control assembly 150. Further, the flush water control valve signal 135 is operative to cause the flush water control valve 134 to permit greater or lesser amounts of flush water to pass therethrough into the flush water pump 132 for injection into the water column of a water well 10 via a flush water injection line 136. As before, a water supply 113 may comprise a water storage tank or a pressurized water source. Further, a flush water assembly 130 may share a water supply 113 with an acid injection assembly 110, such as is shown in the illustrative embodiment of FIG. 4, or alternatively, a separate water supply (not shown) may be provided for a flush water assembly 130.

A water well rehabilitation system 100 in accordance with at least one embodiment of the present invention further comprises a well monitoring assembly 140. In at least one embodiment, a well monitoring assembly 140 comprises a pressure sensor 142. As may be seen from FIG. 2, a pressure sensor 142 is mounted through the well head 11 of the water well 10 and is positioned to measure the pressure in the headspace in the upper portions of the well casing 13. As noted above, a primary concern while performing a water well rehabilitation process is the potential generation of excessive amounts of carbon dioxide which may rise up through the water column in the water well 10, rather than dissipating into the surrounding aquifer, thereby forming gaseous bubbles which seek to rapidly escape from the water well 10, causing a potentially dangerous well kick. A rise in pressure in the headspace above the water column in the water well 10 is an indication that gaseous carbon dioxide is being released. As such, a pressure signal 143 is transmitted to a pressure sensor interface 156 of a system control assembly 150, such as is shown in the illustrative embodiment of FIG. 5. More in particular, in operation, a pressure sensor 142 continuously measures the pressure in the headspace in the upper portions of the well casing 13 throughout a water well rehabilitation process, and a pressure signal 143 transmits the pressure values measured by the pressure sensor 142 to the system control assembly 150 via the pressure sensor interface 156. The pressure sensor interface 156 and/or the system controller 151 are programmed to generate an alarm, which may be audible and/or visible, upon detection of a preselected pressure alarm condition by a pressure sensor 142 mounted in a water well 10.

A preselected pressure alarm condition in accordance with at least one embodiment of the present invention may include a threshold pressure value, or a plurality of threshold pressure values each corresponding to a different alarm condition. As one example, detection of a low threshold pressure value may trigger the generation of a cautionary alarm condition to alert system operators of a minor but measurable increase in pressure in the well casing 13 of the water well 10, which may trigger an automated or manual reduction or termination of the operation of the acid injection assembly 110 and/or the initiation or increase in flush water injection into the water column in the water well via the flush water assembly 130, until such time as the pressure measured in the headspace of the water well 10 remains below the low threshold pressure value for a predetermined period of time. Alternatively, detection of a high threshold pressure value may trigger the generation of a critical alarm condition to alert the system operators of a significant increase in pressure in the well casing 13 of the water well 10 which will automatically terminate operation of the acid injection assembly 110 and increase the rate of flush water injection into the water column in the water well 10 via the flush water assembly 130. As a further precaution, in at least one embodiment of the present invention, the acid injection assembly 110 will not operate for a predetermined period of time and/or until the critical alarm condition has been manually cleared and reset.

It is to be appreciated that alternative and/or additional preselected pressure conditions may be utilized in accordance with the present invention including, but not limited to, a temperature dependent threshold pressure value, a time rate of change in pressure, and/or a pressure differential measured at different elevations within the well casing 13 of the water well 10, just to name a few.

A well monitoring assembly 140 in accordance with at least one further embodiment of the present invention comprises a conductivity sensor 144. More in particular, a conductivity sensor 144 is positioned in a portion of the water column in a water well 10 and is utilized to detect and measure the amount of ions present in the water column, such as are formed by the reaction of the carbonaceous materials with the acid solution. As such, the conductivity sensor 144 is utilized to estimate the rate of reaction occurring in the open borehole 16 of the water well 10. With reference once again to the illustrative embodiment of FIG. 2, a conductivity sensor 144 is positioned proximate the bottom of the well casing 13' in the water well 10, and a conductivity signal 145 is transmitted from the conductivity sensor 144 to the system controller 151 via a conductivity sensor interface 158, such as may be seen in the illustrative embodiment of FIG. 5. Similar to the pressure sensor 142, in operation, one or more conductivity sensors 144 continuously measures the conductivity in a portion or portions the water column in a water well 10 throughout a water well rehabilitation process, and a conductivity signal 145 transmits the conductivity values measured by the conductivity sensor 144 to the system controller 151 via the conductivity sensor interface 158. The conductivity sensor interface 158 and/or the system controller 151 are programmed to generate an alarm, which may be audible and/or visible, upon detection of a preselected conductivity alarm condition by a conductivity sensor 144 mounted in portion of the water column in a water well 10. Also similar to the detection of a preselected pressure alarm condition, in at least one embodiment, detection of a preselected conductivity alarm condition, i.e., detection of a threshold conductivity value, will trigger an automated or manual reduction or termination of the operation of the acid injection assembly 110 and/or the initiation or increase in flush water injection into the water column in the water well 10 via the flush water assembly 130, until such time as the conductivity measured in the portion of the water column in the water well 10 remains below a threshold conductivity value for a predetermined period of time, or as based on other such criteria.

Figure 3:
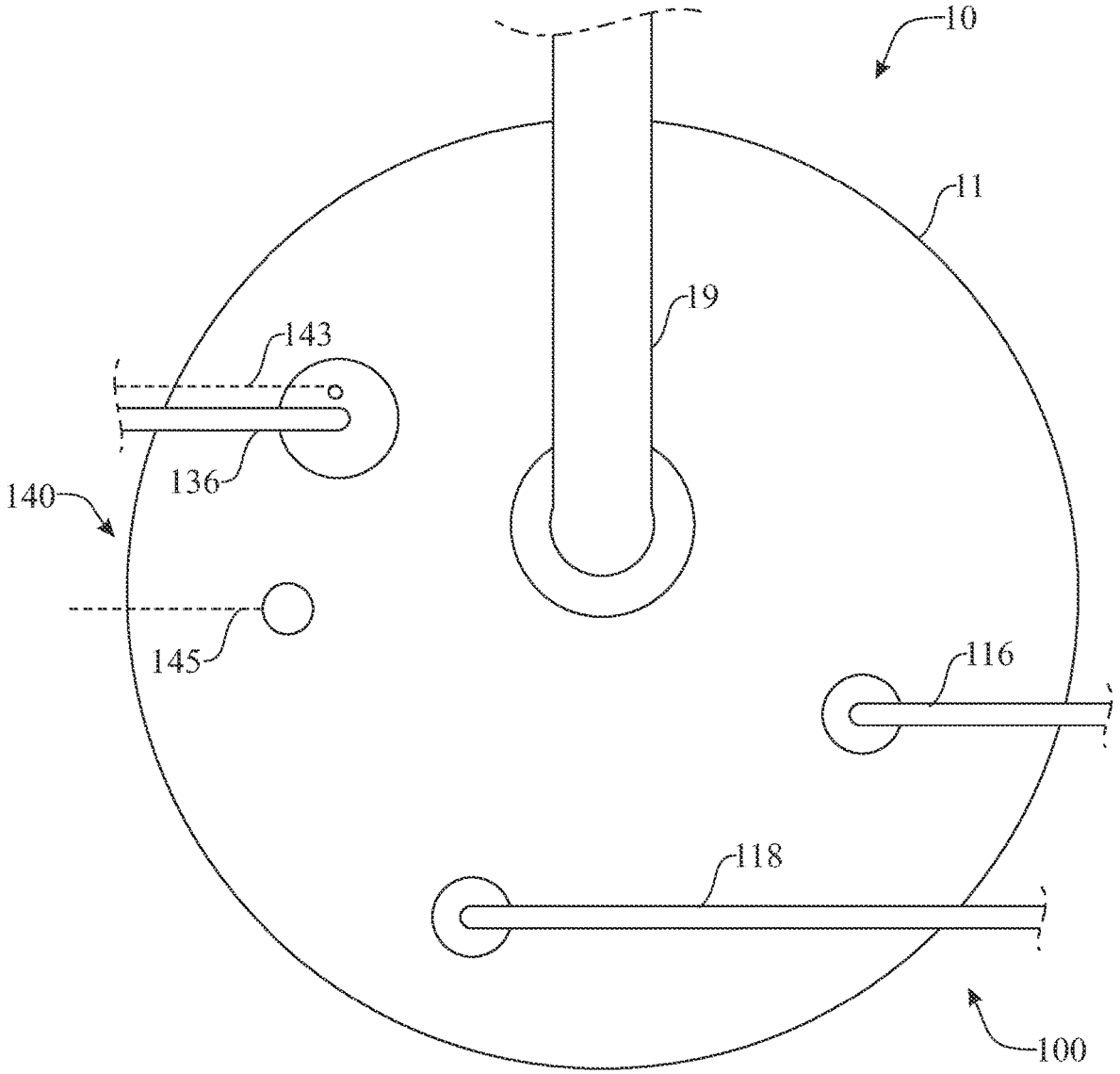
FIG. 3 presents a top plan view of components of one illustrative embodiment of a water well rehabilitation system mounted to a well head of a water well, in accordance with the present invention.

With reference next to FIG. 3, one illustrative embodiment of a well head 11 of a water well 10 having components of a water well rehabilitation system 100 in accordance with the present invention mounted therethrough is presented. As may be seen from FIG. 3, a water discharge pipe 19 is mounted through the well head 11 by an appropriate fitting, such as a flange, sleeve, coupling, etc. Similarly shown in FIG. 3 are an upper acid injection line 116 and a lower acid injection line 118 mounted through the well head 11, once again, by an appropriate fitting, such as a flange, sleeve, coupling, etc. FIG. 3 further illustrates a flush water injection line 136 mounted through a portion of a well head 11, as before, via an appropriate fitting. As previously indicated, the flush water injection line 136 may terminate just below the well head 11 itself, or it may extend downward through a well casing 13 to a point below the static water level 17 in the water well 10.

A pressure signal 143 is represented diagrammatically and may be carried via a wire or a wire in a conduit extending through the well head 11 to pressure sensor 142 positioned, in at least one embodiment, in an upper portion of the headspace in the well casing 13 in the water well 10. A conductivity signal 145 is also represented diagrammatically and may be carried via a wire or a wire in a conduit extending through the well head 11 to conductivity sensor 144 positioned in a portion of the water column in the water well 10, so as to measure the conductivity therein.

Figure 5:
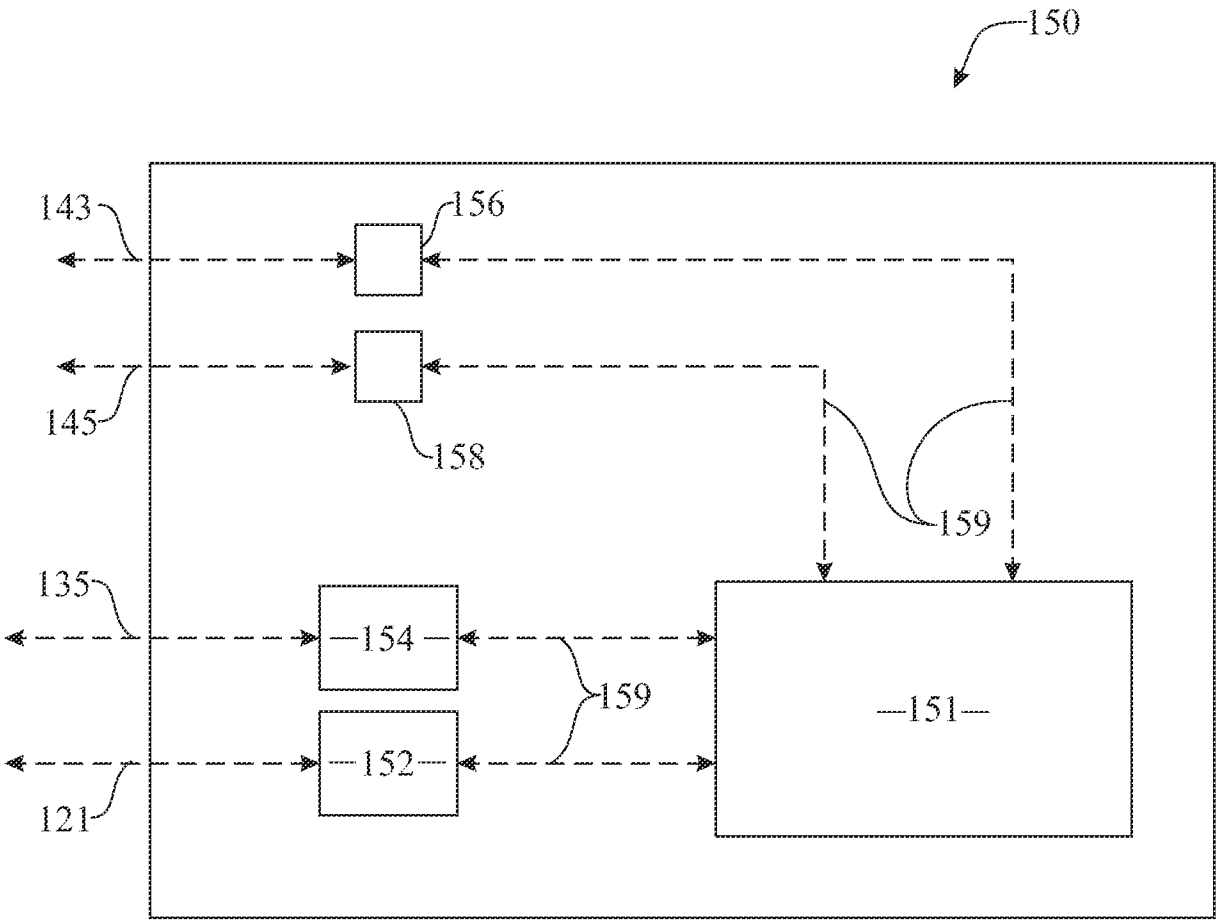
FIG. 5 presents a schematic view of one illustrative embodiment of a system control assembly, in accordance with the present invention.

Looking next to FIG. 5, a diagrammatic representation of one illustrative embodiment of a system control assembly 150 of a water well rehabilitation system 100 in accordance with the present invention is presented. A system controller 151 is provided in at least one embodiment of the present invention to receive and process the monitored parameters and/or alarm signals generated by the various sensors and alarms incorporated in the present system 100. As may be seen from FIG. 5 in at least one embodiment a system control assembly 150 comprises a plurality of interfaces to facilitate communications between the system controller 151 and the various components of the present well water rehabilitation system 100 via a corresponding plurality of interface signals 159.

An acid injection interface 152 is communicative with the system controller 151 via an interface signal 159 to provide a concentration sensor signal 115' and a water supply alarm signal 129 thereto, as well as to receive a water supply control valve signal 123, a concentrated acid control valve signal 125, an upper acid injection line control valve signal 126, and a lower acid injection line control valve signal 127 therefrom, each of the control valve signals 123, 125, 126, 127 transmitted via an acid injection control assembly signal 121 and operative with a corresponding one of control valves 122, 124, 116', 118', respectively, as discussed hereinabove, so as to precisely control an amount and a predetermined acid concentration of an acid solution formed in an eductor 114 and injected into predetermined elevations within an open borehole 16 of a water well 10 during a well water rehabilitation process.

With continued reference to FIG. 5, a flush water injection interface 154 provided in at least one embodiment of the present invention is communicative with the system controller 151 via an interface signal 159 to receive the flush water control valve signal 135 therefrom which is transmitted to and operative with a flush water control valve 134 so as to control an amount of flush water injected into a water well 10 during a water well rehabilitation process.

As also shown in FIG. 5, the system control assembly 150 in at least one embodiment of the present invention further comprises a pressure sensor interface 156 and a conductivity sensor interface 158, each communicative with a system controller 151 via the corresponding interface signal 159 so as to transmit a pressure signal 143 and a conductivity signal 145, respectively, to the system controller 151 during a water well rehabilitation process.

As will be appreciated from the foregoing, the present well water rehabilitation system 100 permits a precisely controlled amount of an acid solution having a precisely controlled predetermined acid concentration into preselected elevations in the water column of an open borehole 16 of a water well 10 during a water well rehabilitation process, so as to minimize if not eliminate altogether the risk of a well kick occurring as a result of a water well rehabilitation process performed utilizing the present water well rehabilitation system 100. As will be further appreciated from the foregoing, the plurality of sensors and alarms including the concentration sensor 115, the pressure sensor 142, the conductivity sensor 144, and the water supply alarm 128 provide redundant measurements indicative of the conditions within a water well 10 as well as throughout the present system 100 during a water well rehabilitation process so as to alert system operators as well as to trigger the system controller 151 to automatically reduce or terminate operation of the acid injection system 110 and/or to initiate or increase injection of flush water into the water well 10 via the flush water assembly 130, once again, so as to minimize if not eliminate altogether the risk of a well kick occurring as a result of a water well rehabilitation process performed utilizing the present system 100.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A water well rehabilitation system for a water well having a well casing installed in a borehole through an upper substrate, a well head mounted to an upper end of the well casing, and an open borehole through an aquifer substrate having a static water level therein, wherein the open borehole extends downward from a bottom of the well casing to the bottom of the water well, said system comprising:

an acid injection assembly including a concentrated acid supply, a water supply, and an eductor disposed to mix an amount of concentrated acid with an amount of water to form an acid solution therein and to inject said acid solution into the water well at at least one predetermined elevation in the open borehole thereof;

an acid injection control assembly having a concentrated acid control valve and a water supply control valve cooperatively operative to maintain a predetermined acid concentration in said acid solution formed in and discharged from said eductor;

a flush water assembly disposed to inject an amount of flush water into the water well; and a well monitoring assembly monitors at least one operating parameter while a rehabilitation process is being performed in the water well.

2. The system as recited in claim 1 wherein said acid injection system further comprises a concentration sensor positioned to measure a concentration of acid in said acid solution discharged from said eductor.

3. The system as recited in claim 2 wherein said concentration sensor generates a concentration sensor signal communicative with said acid injection control assembly to facilitate maintaining said predetermined acid concentration in said acid solution formed in said eductor.

4. The system as recited in claim 1 wherein said acid injection assembly further comprises an upper acid injection line disposed in the open borehole of the water well proximate but below the bottom of the well casing of the water well.

5. The system as recited in claim 1 wherein said acid injection assembly further comprises a lower acid injection line disposed in the open borehole of the water well proximate but above the bottom of the water well.

6. The system as recited in claim 1 wherein said acid injection control assembly further comprises a water supply alarm which generates and transmits a water supply alarm signal upon detection of a low water supply condition.

7. The system as recited in claim 6 wherein said acid injection control assembly causes at least said concentrated acid control valve to close upon receipt of said water supply alarm signal.

8. The system as recited in claim 1 wherein said flush water assembly comprises a flush water pump to inject said amount of flush water into the water well.

9. The system as recited in claim 8 wherein said flush water assembly further comprises a flush water injection line disposed to inject said amount of flush water into the water well proximate but below the elevation of the static water level therein.

10. The system as recited in claim 1 wherein said well monitoring assembly comprises a pressure sensor disposed to measure a pressure proximate the well head of the water well at least while a water well rehabilitation process is being performed in the water well.

11. The system as recited in claim 10 wherein said pressure sensor is further disposed to transmit a pressure signal at least while the water well rehabilitation process is being performed in the water well.

12. The system as recited in claim 1 wherein said well monitoring assembly comprises a conductivity sensor disposed to measure a conductivity in a water column in the open borehole of the water well proximate but below the bottom of the well casing thereof at least while a water well rehabilitation process is being performed in the water well.

13. The system as recited in claim 12 wherein said conductivity sensor is further disposed to transmit a conductivity signal at least while the water well rehabilitation process is being performed in the water well.

14. A water well rehabilitation system for a water well having a well casing installed in a borehole through an upper substrate, a well head mounted to an upper end of the well casing, and an open borehole through an aquifer substrate having a static water level therein, wherein the open borehole extends downward from a bottom of the well casing to the bottom of the water well, said system comprising:

an acid injection assembly having a concentrated acid supply, a water supply, and an eductor disposed to mix an amount of concentrated acid with an amount of water to form an acid solution therein and to inject said acid solution into the water well at one of a plurality of predetermined elevations in the open borehole thereof;

said acid injection assembly further comprises an upper acid injection line disposed in the open borehole of the water well proximate but below the bottom of the well casing of the water well and a lower acid injection line disposed in the open borehole of the water well proximate but above the bottom of the water well;

an acid injection control assembly having a concentrated acid control valve and a water supply control valve cooperatively operative to maintain a predetermined acid concentration in said acid solution formed in and discharged from said eductor;

a flush water assembly comprising a flush water injection line disposed to inject an amount of flush water into the water well proximate but below the elevation of the static water level therein;

a well monitoring assembly monitors at least one operating parameter while a water well rehabilitation process is being performed in the water well; and a system control assembly comprising a system controller to at least monitor the at least one system operating parameter while the water well rehabilitation process is being performed in the water well.

15. The system as recited in claim 14 wherein said acid injection system further comprises a concentration sensor positioned to measure a concentration of acid in said acid solution discharged from said eductor.

16. The system as recited in claim 15 wherein said concentration sensor generates a concentration sensor signal and transmits said concentration sensor signal to said system controller operative with said acid injection control system to cause said concentrated acid control valve and said water supply control valve to allow greater or lesser flow therethrough to maintain said predetermined acid concentration in said acid solution formed in and discharged from said eductor.

17. The system as recited in claim 14 wherein said acid injection control assembly further comprises a water supply alarm which generates and transmits a water supply alarm signal to said system controller upon detection of a low water supply condition, said system controller operative with said acid injection control system to cause said acid injection control assembly to close at least said concentrated acid control valve upon receipt of said water supply alarm signal.

18. The system as recited in claim 14 wherein said well monitoring assembly comprises a pressure sensor disposed to measure a pressure proximate the well head of the water well and transmit said pressure signal to said system controller at least while a water well rehabilitation process is being performed in the water well.

19. The system as recited in claim 14 wherein said well monitoring assembly comprises a conductivity sensor disposed to measure a conductivity in a water column of the open borehole of the water well proximate the bottom of the well casing thereof and transmit said conductivity signal to said system controller at least while a water well rehabilitation process is being performed in the water well.

20. A water well rehabilitation system for a water well having a well casing installed in a borehole through an upper substrate, a well head mounted to an upper end of the well casing, and an open borehole through an aquifer substrate having a static water level therein, wherein the open borehole extends downward from a bottom of the well casing to the bottom of the water well, said system comprising:

an acid injection assembly including a concentrated acid supply, a water supply, and an eductor disposed to mix an amount of concentrated acid with an amount of water to form an acid solution therein and to inject said acid solution into the water well at one of a plurality of predetermined elevations in the open borehole thereof;

said acid injection assembly further comprises an upper acid injection line disposed in the open borehole of the water well proximate but below the bottom of the well casing of the water well and a lower acid injection line disposed in the open borehole of the water well proximate but above the bottom of the water well;

an acid injection control assembly having a concentrated acid control valve and a water supply control valve cooperatively operative to maintain a predetermined acid concentration in said acid solution formed in and discharged from said eductor;

said acid injection system further comprising a concentration sensor positioned to measure a concentration of acid in said acid solution discharged from said eductor;

a flush water assembly comprising a flush water injection line disposed to inject an amount of flush water into the water well proximate but below the elevation of the static water level therein;

a well monitoring assembly monitors a plurality of operating parameters while a water well rehabilitation process is performed in the water well;

a system control assembly comprising a system controller to monitor and adjust a plurality of system operating parameters while the water well rehabilitation process is being performed;

said concentration sensor generates a concentration sensor signal and transmits said concentration sensor signal to said system controller; and said system controller is operative with said acid injection control system to cause said concentrated acid control valve and said water supply control valve to allow greater or lesser flow therethrough to maintain said predetermined acid concentration in said acid solution formed in and discharged from said eductor.

* * * * *